United States Patent [19]

Kohlen

[11] Patent Number: 4,664,335

[45] Date of Patent: May 12, 1987

[54] CREEL FOR WARPING MACHINE

[75] Inventor: Karl-Heinz Kohlen, Monchen-Gladbach, Fed. Rep. of Germany

[73] Assignee: Hacoba Textilmaschinen GmbH & Co. KG, Wuppertal, Fed. Rep. of Germany

[21] Appl. No.: 785,559

[22] Filed: Oct. 7, 1985

[30] Foreign Application Priority Data

Oct. 6, 1984 [DE] Fed. Rep. of Germany ..... 3436714

[51] Int. Cl.[4] ..... B65H 49/00; B65H 59/22

[52] U.S. Cl. ..... 242/131.1; 28/194; 242/149

[58] Field of Search ..... 242/131.1, 131, 147 R, 242/149, 150 R, 150 M; 28/190, 193, 194

[56] References Cited

U.S. PATENT DOCUMENTS

| | | | |
|---|---|---|---|
| 1,790,553 | 1/1931 | Peterson | 242/131.1 X |
| 1,940,477 | 12/1933 | Abbott | 28/194 |
| 2,021,032 | 11/1935 | Swanson | 242/131.1 X |
| 2,133,507 | 10/1938 | Guild | 242/131.1 |
| 2,491,438 | 12/1949 | Bodansky | 28/194 |
| 2,542,097 | 2/1951 | Shaffer et al. | 242/131.1 |
| 2,547,072 | 4/1951 | Bauer | 242/131.1 X |
| 2,558,033 | 6/1951 | Bauer et al. | 28/194 |
| 3,873,043 | 3/1975 | Wildi et al. | 242/131.1 |
| 4,133,492 | 1/1979 | Derichs et al. | 242/150 R |
| 4,566,651 | 1/1986 | Kupper | 242/150 R |

FOREIGN PATENT DOCUMENTS 322339 12/1929 United Kingdom ..... 242/131.1

*Primary Examiner*—Stanley N. Gilreath

*Attorney, Agent, or Firm*—Karl F. Ross; Herbert Dubno

[57] ABSTRACT

A creel for supplying yarns from a plurality of respective packages to a takeup machine such as a warp winder has a support defining respective supply stations carrying the yarn packages, respective stationary brake elements on the supports at the stations each having a braking surface, respective tension-sensing deflectors at the stations, and guides for directing the yarns from the respective packages over the respective braking surfaces and around the respective deflectors. Respective movable jaws movable toward and away from the respective stationary jaws can be actuated via respective springs to press against the yarns on the respective surfaces with a force capable of varying smoothly and steplessly up to a relatively high nominal level corresponding to high tension in the respective yarn. A sensor connected to the deflector responds when the tension in the yarn at the deflector drops below a predetermined low tension, typically to signal a shutdown of the takeup machine so the break can be repaired. A controller effective on startup of the takeup machine maintains the force at the high level for a predetermined interval and thereafter uniformly and smoothly decreasing the force.

15 Claims, 9 Drawing Figures

CREEL FOR WARPING MACHINE

FIELD OF THE INVENTION

The present invention relates to a creel for a warping machine or the like. More particularly this invention concerns such a creel having individual filament control devices for each yarn supply.

BACKGROUND OF THE INVENTION

A standard creel has a plurality of stations each provided with a support for a respective yarn package, a respective thread brake that maintains a predetermined minimum tension in the filament between it and the downstream warp beam or the like, and a respective thread clip. These clips are all ganged and are opened simultaneously when the machine is started up and similarly closed simultaneously when the machine is stopped to keep the yarn taut.

It is standard in such arrangements to provide for each yarn supply a respective sensor which detects the tension in the respective yarn and responds when this tension drops below a certain threshold, as when a yarn breaks or runs out. A controller connected to all of the sensors immediately arrests the takeup beam of the warping machine or similar device when any of the tension sensors outputs a low-tension signal. In this manner it is possible to correct the problem, typically by rethreading the broken filament through the respective brake and clip and knotting it to the free end of the package it broke off or to the free end of a new package, and then restart the machine.

As described in German Pat. No. 3,100,880 the thread brake used to control tension during startup of the machine is formed as a pair of parallel and spaced vertical rods extending past each vertical row of yarn supplies. The respective yarns pass between these rods, one of which is movable relative to the other to vary the contact line, that is the length of the piece of filament contacting both rods at one time, and thereby vary drag on the yarn. Such a brake is provided, in the filament travel direction, upstream of the tension sensor, and is set for maximum contact and, therefore, maximum drag at startup to prevent the sensor from responding. Once the yarn is up to speed the drag is normally backed off at the brake since most frictional drag is proportional to speed so that the drag at other points is sufficient to maintain the yarn tension above the response threshold of the low-tension detector. In this system the thread clip, which is independent of the brake, releases the filament as the machine is started up, a release which is not altogether instantaneous to reduce wear to the jaws of the clip.

This system puts considerable stress on the yarn since the tension during startup at least momentarily exceeds the tension necessary to wind it up. In addition the tension varies due to the rapid opening of the respective clip in connection with the slow tension increase as the takeup element gets up to speed and with the speed-related effectiveness of the rod-type brake. In addition the device is expensive to make so it gives satisfactory and uniform results.

OBJECTS OF THE INVENTION

It is therefore an object of the present invention to provide an improved creel assembly.

Another object is the provision of such a creel assembly which overcomes the above-given disadvantages, that is which reduces peak tension on the filaments while allowing the system to operate at extremely high speeds.

A further object is the provision of an improved method of operating a creel assembly.

Yet another object is to provide an improved filament brake and holder particularly suited for carrying out the method of this invention.

SUMMARY OF THE INVENTION

A creel for supplying yarns from a plurality of respective packages to a takeup machine according to the invention has a support defining respective supply stations carrying the yarn packages, respective stationary brake elements on the supports at the stations each having a braking surface, respective tension-sensing deflectors at the stations, and guides for directing the yarns from the respective packages over the respective braking surfaces and around the respective deflectors. Respective movable jaws movable toward and away from the respective stationary jaws can be actuated via respective springs to press against the yarns on the respective surfaces with a force capable of varying smoothly and steplessly up to a relatively high nominal level corresponding to high tension in the respective yarn. A sensor connected to the deflector responds when the tension in the yarn at the deflector drops below a predetermined low tension, typically to signal a shutdown of the takeup machine so the break can be repaired. A controller effective on startup of the takeup machine maintains the force at the high level for a predetermined interval and thereafter uniformly and smoothly decreasing the force.

Thus with the system of this invention the separate clip of the prior art is replaced by the brake, which is set up not only so that it can oppose the advance of the filament engaging it with an adjustable force, but also so that it can actually clip and arrest the filament. The brake can exert a force of, for example, 15 centinewton (CN) which is sufficient to arrest the filament instantaneously, but this holding force can then be gently backed off as the filament gets up to speed and other factors such as air resistance increase their drag on the filament. The particular rate of clamping release can be controlled by a simple cam on startup of the takeup machine or can otherwise be under electronic control.

According to this invention each movable jaw is rigid and elongated with opposite ends and the respective spring is a generally straight leaf spring extending parallel to the respective movable jaw between the ends thereof and mounted therein for bending perpendicular to the respective jaws. In addition each actuator includes a second curved leaf spring concave away from the respective straight spring, centrally fixed thereto, and having a pair of opposite ends. A support rod extending and displaceable generally parallel to the movable jaw fixed to one end of the respective curved spring whose other end is slidable thereon so that an abutment on the support can engage the respective other spring end and move it. A linear actuator connected to all of the rods can displace same longitudinally and thereby press the other spring ends against the respective abutments and thereby bow the respective curves springs toward the respective braking surfaces. Such an arrangement can be made extremely sensitive. It can be calibrated easily and can be counted on to operate for long periods without changing spring characteristic. The brakes can be used for thick or thin filaments since the friction area is relatively large.

The support of the instant invention includes a plurality of beams each traversing at least one station and formed thereat with a respective throughgoing cutout. The movable jaws are abutment plates overlying and having the respective braking surfaces exposed in the respective cutouts. In addition at each station a spacer plate is provided which is formed with a cutout aligned with the respective beam cutout and sandwiched between the respective abutment plate and the beam. Thus each abutment plate forms a vertically very narrow slot through which the yarn passes, so that its upstream movement is completely eliminated at least vertically. This makes the deflector more accurate in its measurement of yarn tension, as such measurement is difficult on a wavering yarn of the type in the machines of the prior art.

In addition according to this invention the abutment plates each have one end turned up away from the respective beam and each station has an antireturn tab also turned up away from the respective beam adjacent but opposite the turned-up end of the respective abutment plate. This structure makes threading a yarn through the device a simple slide-in maneuver.

The beam according to this invention is downwardly U-shaped and each deflector is pivotal and normally projects upward past the beam. The respective spacer plates are each formed with a cutout through which the respective pin projects. This makes the system quite rugged, while protecting the mechanism of the tension sensor inside the downwardly open U-section beam.

Each station of the system of this invention is provided with a respective shield plate formed centrally with a guide hole constituting part of the guide and extending generally perpendicular to the yarn traversing the hole. This shield plate is unitary with the respective spacer plate. This construction is extremely rugged and simple, and ensures that the balloon of the upstream yarn will not get tangled in the mechanism.

Furthermore according to the invention each station is provided with a respective abutment aligned between the respective deflector and hole and lying in a normal direction of travel of the yarn from the hole between the respective deflector and braking surface. Each abutment is so aligned between the respective hole and the respective deflector that a yarn passing through the hole, over the braking surface, and around the deflector tangentially touches the respective abutment. Since the yarn always touches the deflector, it always impinges the deflector over the same contact arc. Thus horizontal wavering of the yarn is also eliminated.

According to this invention a spring setup is effective against all of the actuating means for continuously urging the respective movable jaws away from the respective braking surfaces. The single actuator acts oppositely, so that the braking force can be accurately set.

Each deflector of this invention with the respective guiding means defines for the respective yarn a path of travel extending in a straight line from the deflector to the takeup machine and extending to the deflector at an obtuse angle to contact the deflector over an angle of less than 90°, normally between 35° and 60°, and preferably about 54°. This angle is fairly small so that overall resistance to movement in the device of this invention is small and therefore higher yarn speeds, above 1000 m/min, can be used.

DESCRIPTION OF THE DRAWING

The above and other features and advantages will become more readily apparent from the following, reference being made to the accompanying drawing in which.

SPECIFIC DESCRIPTION

Figure 1:
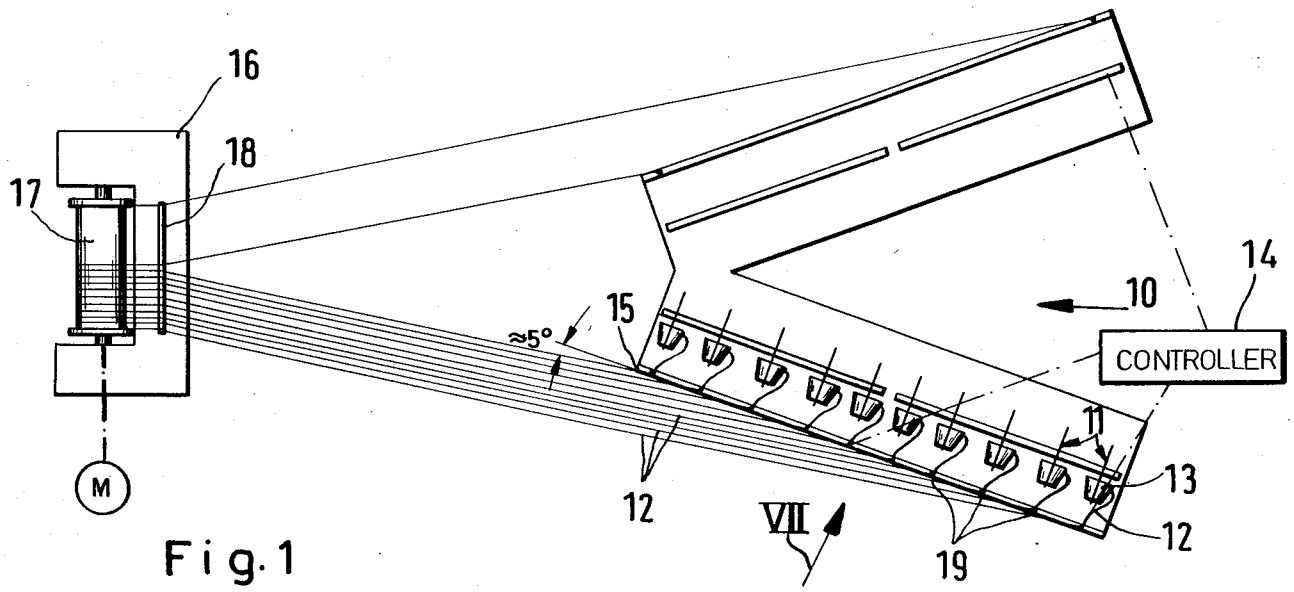
FIG. 1 is a small-scale top view of the system of this invention.
Figure 7:
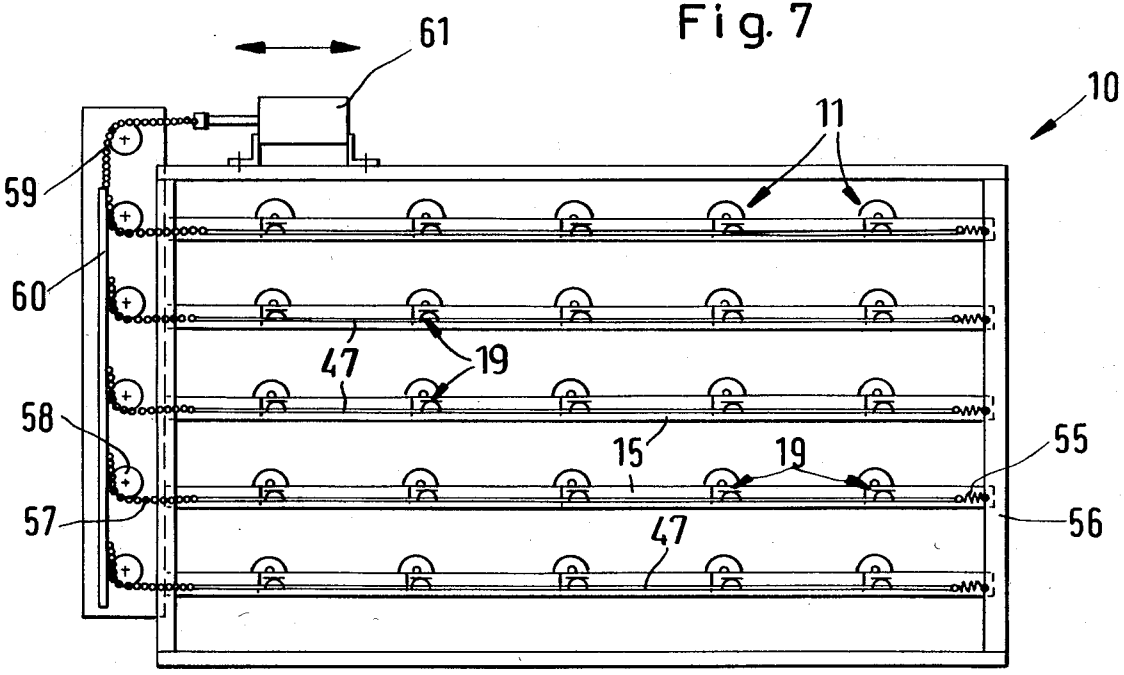
FIG. 7 is a small-scale side view of the system taken in the direction of arrow VII of FIG. 1.

As seen in FIGS. 1 and 7 a V-shaped creel 10 defines a multiplicity of supply stations 11 arranged in two vertical banks. Each station 11 comprises a respective package or supply spool 13 centered on a horizontal axis A (FIG. 4) and from which a respective yarn or filament 12 is pulled through a respective brake 19. Each side of the creel 10 has a plurality of vertically spaced support beams 15 fixed in a stationary frame 56 (FIG. 7 only) and each having in turn a plurality of such supply stations 11 with the axes A perpendicular to the beams 15. The yarns 12 are pulled at an angle of about 5° from the respective stations 11 through a comb 18 of a warp-forming machine 16 having a beam or roll 17 drivable at a peripheral speed of upward of 800 m/min. A controller 14 operates the drive for the beam 17.

Figure 2:
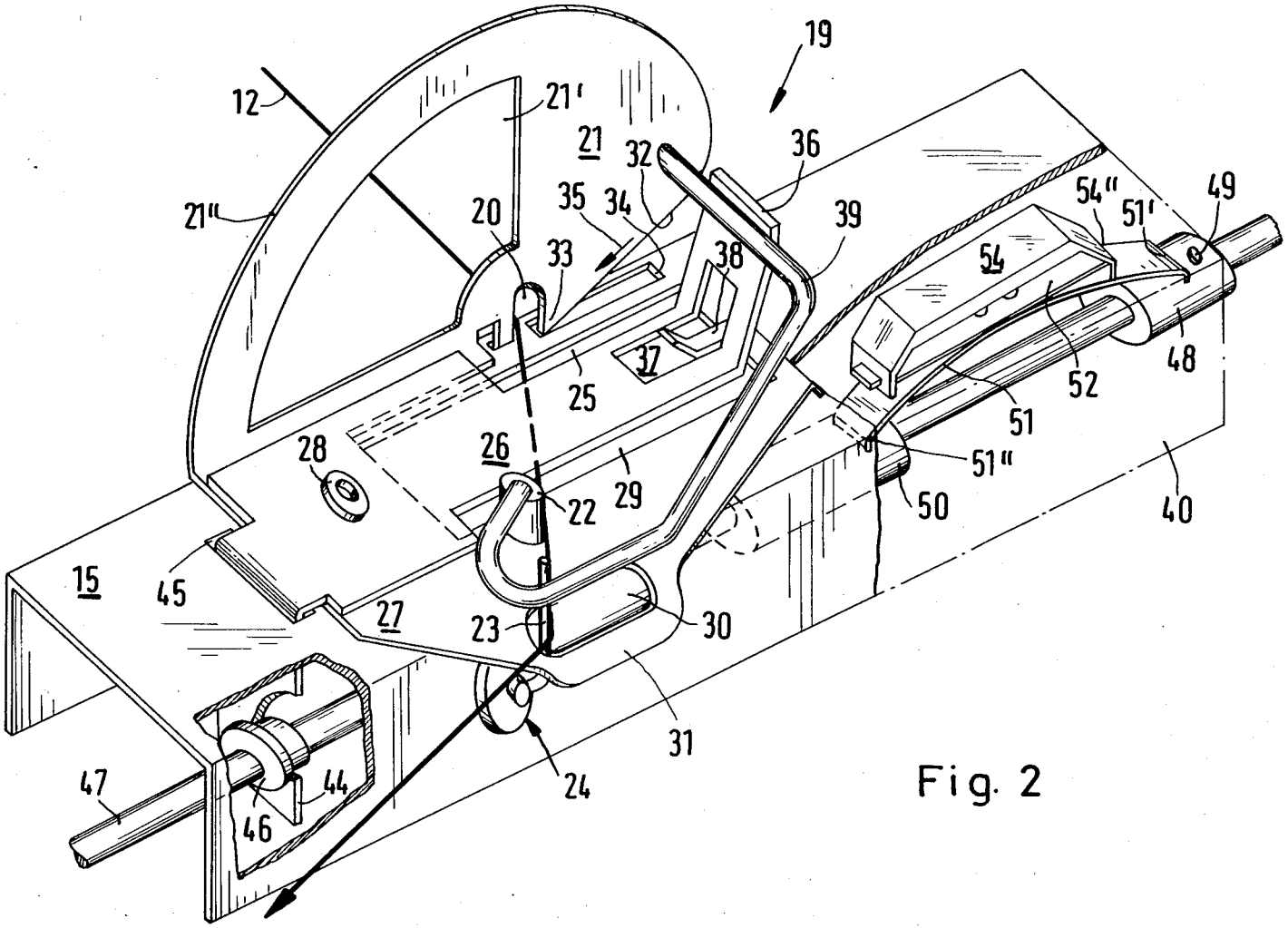
FIG. 2 is a partly broken-away and large-scale perspective view of the thread brake/guide/deflector unit according to this invention.
Figure 3:
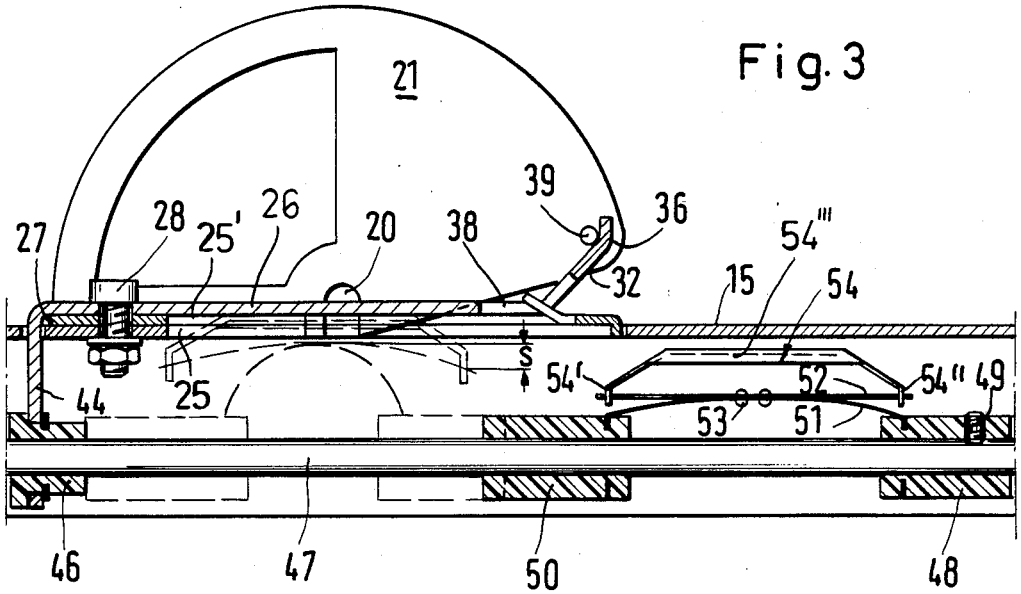
FIGS. 3 and 4 respectively are longitudinal and cross sections through the unit of FIG. 2.
Figure 4:
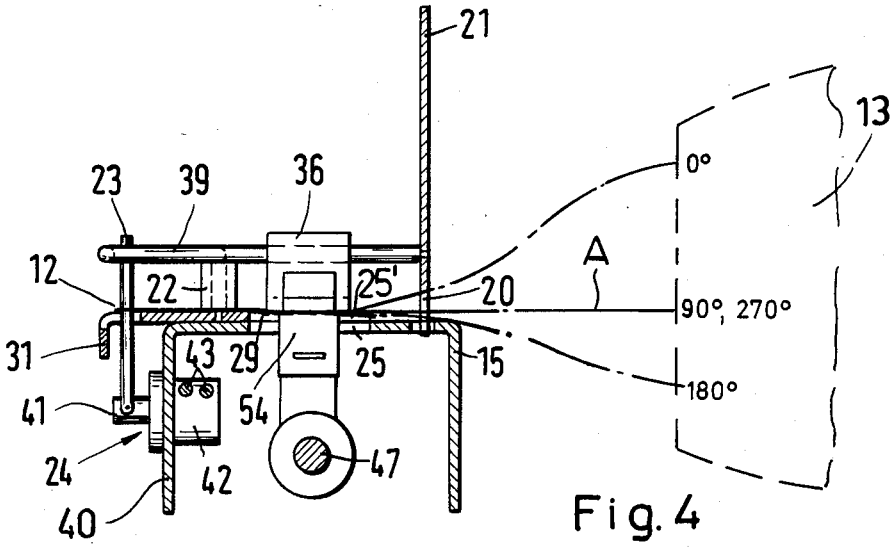

As best seen in FIGS. 2, 3, and 4, each unit 19 has a semicircular and upright plate 21 formed with a yarn-inlet hole 20, with a weight-sparing cutout 21', and with a semicircular gauge edge 21''. After passing through this hole 20 the yarn passes around a deflector 22, then over the sensor pin 23 of a tension sensor 24 connected to the controller 14, and thence at 5° to the respective beam 15 to the comb 18.

The beam 15 is formed with a rectangular cutout 25 and downstream in the final direction of displacement of the yarn 12 therefrom with a transverse slot 45. The unit 19 basically comprises an abutment plate 26 of stiff metal construction overlying the window 25 and forming a vertically open slot 29 therewith and a thinner carrier plate 27 formed with a cutout 25' exactly overlying the cutout 25. The plate 27 is formed at one edge with a bent down part 31 formed with a cutout 30 through which the sensor pin 23 normally extends and its other end is bent up to form the plate 21, which therefore is unitary with the plate 27. The plate 27 is sandwiched between the lower surface of the plate 26 and the upper surface of the horizontal web of the downwardly U-section beam 15 to space the plate 26 above the beam 15, and a nut and bolt 28 secure the two plates 26 and 27 down onto the support beam 15 with a downstream transverse tab 44 of the upper plate 26 projecting through and anchored in the slot 45 (FIG. 3). Thus this simple attachment bolt 28 not only secures the plates 26 and 27 together, but otherwise secures the entire brake assembly 19 to the beam 15, allowing for easy servicing and replacement.

Furthermore, the plate 21 is formed with an inclined upstream edge 32 formed at its downstream end with an antireturn tip 33 that projects with all-around play slightly down into a cutout 34 formed in the horizontal cross web of the beam 15. The downstream edge of this tip 33 is perpendicular to the beam 15 and the edge 32 is, as mentioned, inclined so a filament pulled in direction 35 into the space between the edge 32 and the beam 15 will be able to move in this direction 35 into the hole 20, but will not be able to move back in the opposite direction.

Similarly the upstream end of the stiff plate 26 is bent up at 36 at an acute angle to the beam 15 and is formed with a central cutout 37 into which extends a bent-up tab 38 integrally formed at the front end of the plate 27 and extending backward in the direction 35. It is therefore possible to load a yarn 12 into the device 19 simply by grabbing a short portion of it between the two hands and pulling it back in the unit 19 with one hand on each side of the beam 15 so that it slides under the edge 32 and over the tab 38, ending in the illustrated position with a portion of the filament 12 exposed downward under the bottom of the plate 26. The only way practical to take a yarn 12 out of the device is to pull it through.

The entire unit is stabilized by a stiff wire 39 having one end fixed in the abutment 22 and another end in the plate 21 while passing around the pin 23 and being connected to the upper end of the tab 36. This wire 39 not only makes the entire unit much more rigid, but also serves as a protector or guard like the plate 21 that prevents a loose filament from tangling in the mechanism.

The sensor 24 comprises a pin 41 pivotal on one leg 40 of the U-section beam 15 about an axis transverse to the respective beam 15 and carrying a switch unit 42 that electrically interconnects two rods 43 whenever the sensor pin 23 carried by this pin 41 is moved as seen in FIG. 2 clockwise against the opposite force of a torque spring or the like. Thus when tension in the respective filament 12 drops below a predetermined threshold, as when the filament 12 breaks or runs out, the switch 42 reacts to signal the drive for the beam 18 to stop. A new yarn is tied onto the trailing broken end that is not yet wound up on the beam 18, to which end it is stopped rapidly, and the system is restarted. The upstream edge of the cutout 30 blocks the pin 23 from pivoting below the surface of the beam 15 when not pulled oppositely back by a filament 12 so as to ease such reloading of the device.

The braking effect is necessary to calm the action of the filament, which is pulled off the package 13 whose horizontal axis A is roughly aligned with the opening 20 perpendicular to the respective beam 15. Several turns of the yarn 12 are pulled each second off the respective package 13, the yarn 12 coming from a point which moves in a continuous three-dimensional spiral centered on the spool axis to form a so-called balloon. The spools 13 are typically frustoconically tapered toward the opening 20 so that the balloon also is centered on a horizontal axis.

Figure 5:
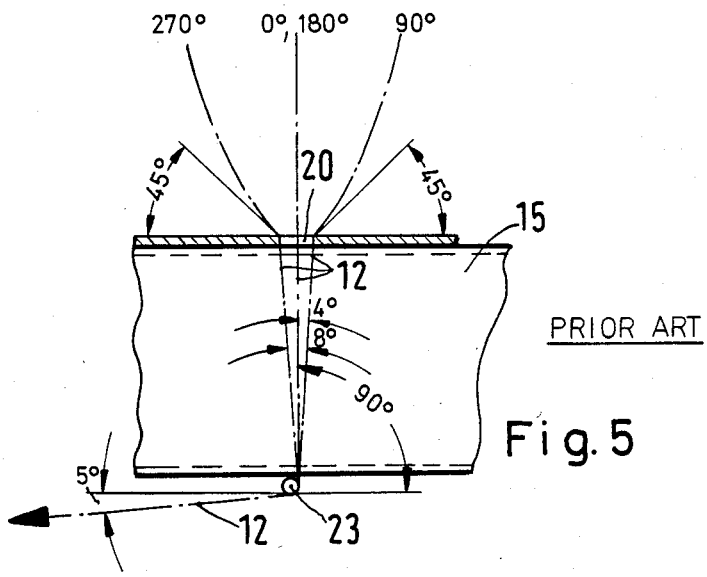
PRIOR ART Fig. 5
FIGS. 5 and 6 are partial cross-sectional and top views illustrating operation of a prior-art device and of the unit of FIG. 2, respectively.

FIG. 5 shows how the relative positions of the sensor pin 23 and inlet guide hole 20 are critical. As seen in the prior-art arrangement in FIG. 5 the filament 12 is deflected through 90° around the pin 23 which is located perpendicularly across the beam 15 from the hole 20, so that a tangent from the downstream edge of the pin 23 passes perpendicularly across the beam 15 and through the center of the hole 20. The respective spool 13 is typically frustoconical and mounted so that it tapers toward the guide 20 and in fact its axis passes therethrough, so that as the yarn 12 is pulled from it at a rate of several revolutions per second, it originates from a point on the spool that moves through 360° around this axis and simultaneously moves radially in and out. The result is that where the balloon thus formed passes through the hole 20 the yarn 12 moves about the periphery of this hole 20 typically forming an angle of 45° at this hole 20, which angle is typically determined by a funnel guide opening at the eye 20 and having a conicity of 90°. With the general dimensions shown in FIG. 5, this adds or subtracts 4° to the 90° angle at the 90° and 270° positions which are horizontally offset from each other parallel to the beam 15 but has no effect on this angle of 90° at the vertical 0° and 180° positions. Thus the total contact angle can be seen to be the following:

TABLE I

| Position | At guide | At deflector | Total |
|---|---|---|---|
| 0° | 45° + | (90° − 5°) = | 130° |
| 90° | (45° − 4°) + | (90° − 5° − 4°) = | 122° |
| 180° | 45° + | (90° − 5°) = | 130° |
| 270° | (45° − 4°) + | (90° − 5° + 4°) = | 130° |

Figure 9:
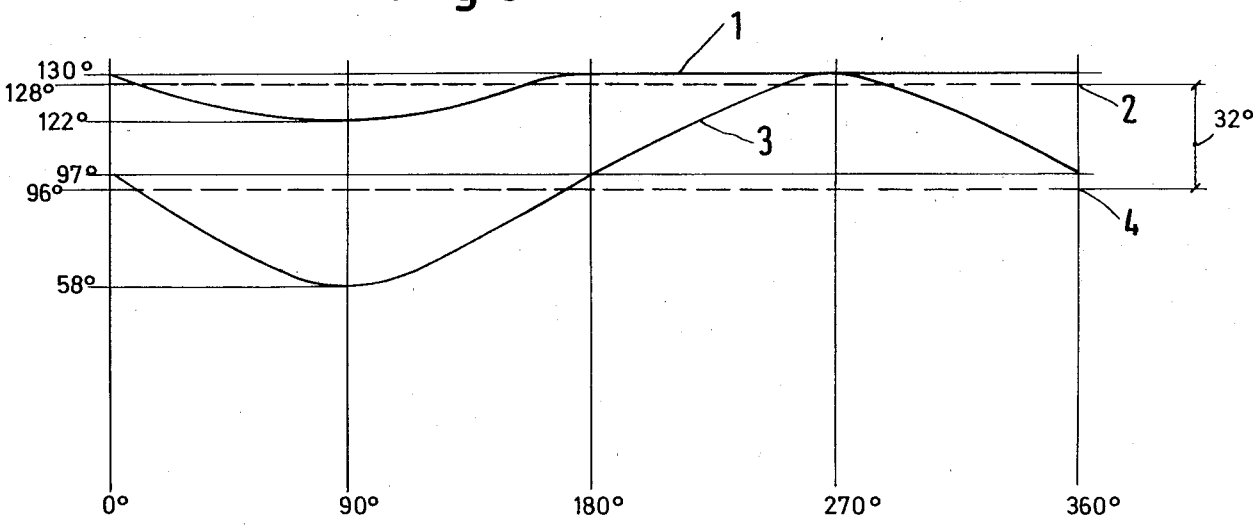

FIG. 9 illustrates this graphically. The line 1 is the total contact angle, that is the angle along which the filament directly contacts something while running through the prior-art device while the line 2 shows the average contact arc.

Figure 6:
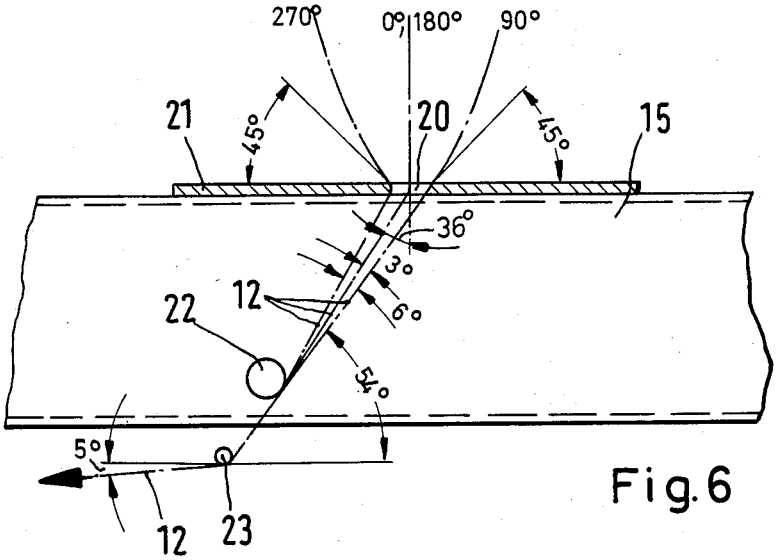

On the other hand, the total contact angle for the system of this invention, as illustrated in FIG. 6, is shown below:

TABLE II

| Position | At guide | At deflector | Total |
|---|---|---|---|
| 0° | (45° + 3°) + | (54° − 5°) = | 97° |
| 90° | (45° − 36°) + | (54° − 5° − 4°) = | 58° |
| 180° | (45° + 3°) + | (54° − 5°) = | 97° |
| 270° | (45° + 36°) + | (54° − 5° + 4°) = | 130° |

FIG. 9 illustrates this graphically for FIG. 6 also. The line 3 is the total contact angle, and the line 4 shows the average contact arc. Thus with the system of this invention, with the abutment 22 and 23 arranged downstream so the contact angle at them is only 49° to 54° while that at the guide varies from 9° to 81°, the average angle is some 32° smaller than in the prior-art system. This reduces the tension resulting from friction by 10% to 15% at a filament travel rate of 800 m/min. As a result this travel speed can be increased correspondingly without exceeding the tension at which the filament will rupture.

Figure 8:
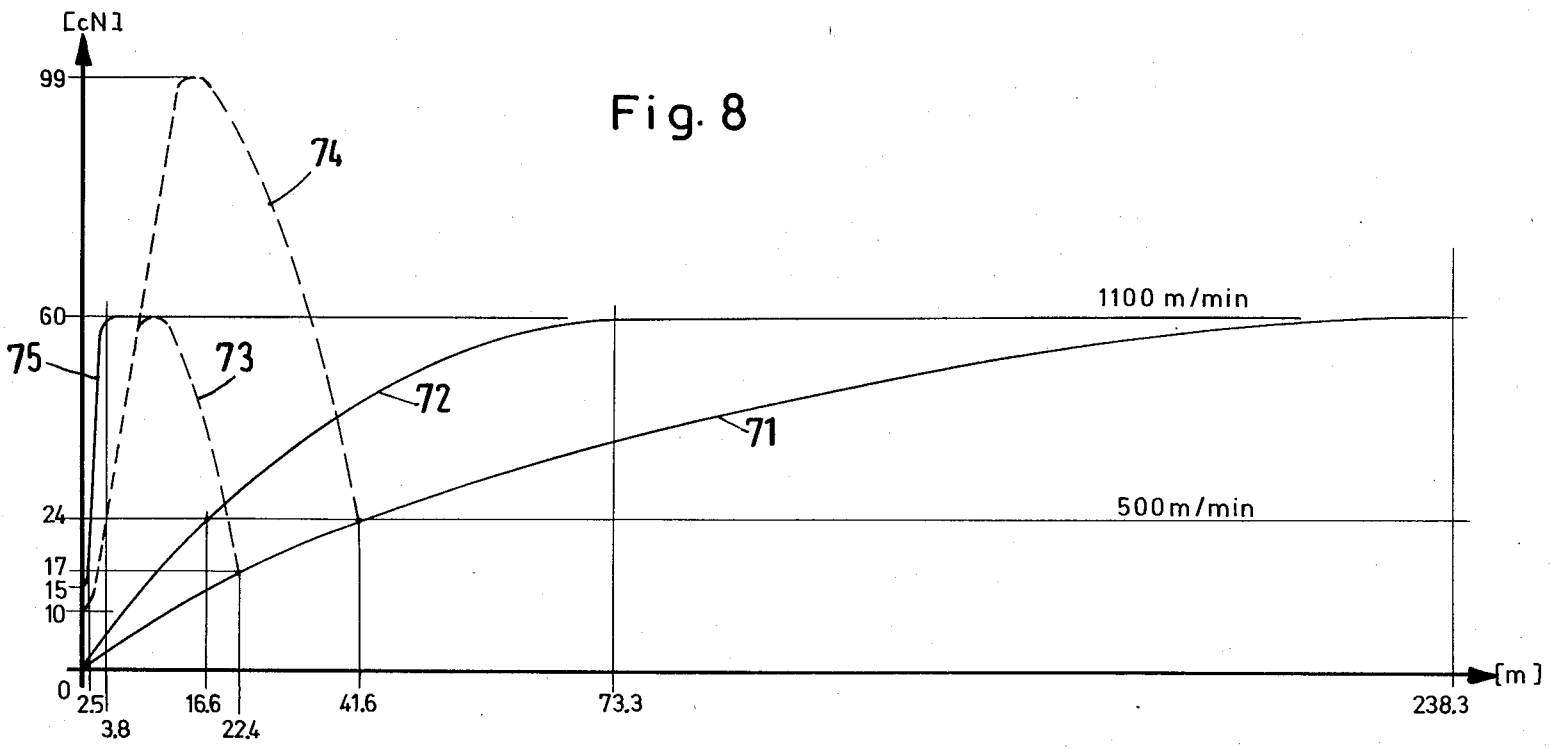
FIGS. 8 and 9 are graphs showing the operation of the system of this invention.

In FIG. 8 the length of filament pulled through the device is shown in meters on the abscissa and the tension in the filament is shown in centinewtons on the ordinate, with the startup point at the origin. The sensor 24 is set to shut down the system if tension drops below 24cN. With a standard motor the tension would naturally rise as shown on line 71, with the response threshold being crossed after 41.6 m of yarn have been pulled out and a speed of 500 m/min reached. Thereafter it rises to the maximum level of 60 cN at 1100 m/min. If the motor power is increased the curve 72 will be created, with the threshold response being reached at 16.6 m of yarn. Even this latter waste, using an expensive and heavy-duty drive motor, is normally considered excessive.

Normally when the filament is stationary it is clamped so tightly that the filament cannot slip until the filament tension is 10 cN, and thereafter the unit keeps the pressure on until maximum tension, here 60 cN, and then the clamp releases suddenly, causing the tension to drop suddenly as shown at curve 73, thereby momentarily dropping below the threshold of 24 cN so that this device must still be cut out until 41.6 m of yarn has been pulled out, as in curve 71, even though at 3.8 m the tension originally passed the threshold. The curve 74 shows what happens when the clamp is maintained closed so that even the sudden falloff after its opening does not drop below 24 cN, here at 41.6 m. This type of operation requires, however, a peak tension of 99 cN which is likely to break the yarn.

According to the instant invention the unit 19 of the instant invention is operated by the actuator 61 to produce the curve shown at 75 in FIG. 8. The pressure is set so that the filament will not slip until tensioned at 15 cN so that the rate of tension increase is steeper and by the time the desired tension of 60 cN is reached only 3.8 m of yarn has been payed out and after only 2.5 m the sensor threshold of 24 cN has been passed. Thus the sensor can be cut in at 2.5 m. Once the desired tension is achieved according to this invention the pinching force is gradually let off so that it stays at the desired level of 60 cN.

This tension is controlled by pressing a brake spring 54 against the filament 12 where it passes under the plate 26. To this end as best seen in FIGS. 2, 3, and 4 each beam 15 has a respective control rod 47 passing through slide bushings 46 in respective tabs 44 and carrying at each brake 19 a collar 48 secured to the rod 47 by a respective screw 49. A downwardly concave leaf spring 51 has a rear end 51' seated in the collar 48 and a front end 51'' seated in a collar 50 that is longitudinally slidable on the rod 47, unlike the collar 48. This spring 51 is secured at central rivets 53 to the center of a straight spring 52 whose outer ends carry the ends 54' and 54'' of the brake element 54, which has turned down sides 54''' so that it is fairly rigid and smooth. As the element 54 is fairly rigid the spring 52 can normally slide in one of its ends 54' or 54'' to allow the spring 52 to bend while the element 54 remains straight.

As seen in FIG. 7 each of these rods 47 is pulled by a spring 55 connected to the frame 56 into a position pulling the brake elements 54 completely out from underneath the respective openings 25. The rods 47 have opposite ends connected to chains 57 passing under idler wheels 58 and all connected to a vertical bar 60 connected to another chain 59 operated by a hydraulic or pneumatic cylinder 61 of the accurate positioning type under the control of the control unit 14. When the cylinder 61 contracts it can pull the assembly 48—54 to the dashed-line position of FIG. 3 to press the collar 50 against the journal 46 and bend the spring 51 upward. This action presses the element 54 against the filament 12 passing underneath the plate 26.

The vertical stroke s shown in FIG. 3 represents the vertical displacement of the rivet part of the spring 51 between the instant when it makes or loses contact with the plate 26 and the instant when it is pushing upward thereagainst with maximum force. This vertical displacement, which corresponds to a longer horizontal displacement of the respective bar 47 allows the actuator 61 to accurately control the pressure the element 54 exerts on the plate 26. This pressure is, of course, proportional to the tension in the respective filament so that this tension in turn can be controlled very accurately. Furthermore, since as seen in FIG. 6 the total possible variation of the path followed by the yarn 12 while it is in contact with the bottom of the plate 26 is only 6°, there is no consequential variation in the contact length, that is in the length of the piece of yarn in contact with the plate 26. As a result the amount of yarn pulled off the package will also have no consequential effect on the yarn tension.

I claim:

1. A creel for supplying yarns from a plurality of respective packages to a takeup machine, the creel comprising:

a support defining respective supply stations carrying the yarn packages;

respective stationary brake elements on the supports at the stations each having a braking surface;

respective tension-sensing deflectors at the stations;

means for guiding the yarns from the respective packages over the respective braking surfaces and around the respective deflectors, the deflectors being displaceable through positions corresponding to the tension in the respective yarns;

respective movable jaws moveable toward and away from the respective stationary brake elements;

actuating means including respective springs bearing on the moveable jaws for pressing same against the yarns on the respective surfaces with a force capable of varying smoothly and steplessly up to a relatively high nominal level corresponding to high tension in the respective yarns;

respective sensor means connected to the deflectors for responding when the tensions in the respective yarns at the deflectors drop below a predetermined low tension and the respective deflectors assume the corresponding positions; and control means connected to the actuator means and effective on startup of the takeup machine for maintaining the force at the high level for a predetermined interval and thereafter uniformly and smoothly decreasing the force.

2. The creel defined in claim 1 wherein each movable jaw is rigid and elongated with opposite ends and the respective spring is a generally straight leaf spring extending parallel to the respective movable jaw between the ends thereof and mounted therein for bending perpendicular to the respective jaws.

3. The creel defined in claim 2 wherein each actuator includes a second curved leaf spring concave away from the respective straight spring, centrally fixed thereto, and having a pair of opposite ends, a support rod extending and displaceable generally parallel to the movable jaw, means securing one end of the respective curved spring fixedly to the rod and the other end slidable thereon, an abutment on the support operatively engageable with the respective other spring end, and a linear actuator connected to all of the rods for displacing same longitudinally and thereby pressing the other spring ends against the respective abutments and thereby bowing the respective curves springs toward the respective braking surfaces.

4. The creel defined in claim 1 wherein the support includes a plurality of beams each traversing at least one station and formed thereat with a respective throughgoing cutout, the movable jaws being abutment plates overlying and having the respective braking surfaces exposed in the respective cutouts.

5. The creel defined in claim 4, further comprising at each station a spacer plate formed with a cutout aligned with the respective beam cutout and sandwiched between the respective abutment plate and the beam.

6. The creel defined in claim 5 wherein the abutment plates each have one end turned up away from the respective beam and each station has an antireturn tab also turned up away from the respective beam adjacent but opposite the turned-up end of the respective abutment plate.

7. The creel defined in claim 5 wherein each deflector is a pivotal normally projecting upward past the beam, the respective spacer plates each being formed with a cutout through which the respective pin projects.

8. The creel defined in claim 5 wherein each station is provided with a respective shield plate formed centrally with a guide hole constituting part of the guiding means and extending generally perpendicular to the yarn traversing the hole.

9. The creel defined in claim 8 wherein each shield plate is unitary with the respective spacer plate.

10. The creel defined in claim 8 wherein each station is provided with a respective abutment aligned between the respective deflector and hole and lying in a normal direction of travel of the yarn from the hole between the respective deflector and braking surface, each abutment being so aligned between the respective hole and the respective deflector that a yarn contacting passing through the hole, over the braking surface, and around the deflector tangentially touches the respective abutment.

11. The creel defined in claim 1 further comprising spring means effective against all of the actuating means for continuously urging the respective movable jaws away from the respective braking surfaces.

12. The creel defined in claim 1 wherein each deflector with the respective guiding means defines for the respective yarn a path of travel extending in a straight line from the deflector to the takeup machine and extending to the deflector at an obtuse angle to contact the deflector over an angle of less than 90° .

13. The creel defined in claim 12 wherein the angle is between 35° and 60°.

14. The creel defined in claim 1, further comprising respective means for releasably securing the brake element, guiding means, movable jaw, and deflector of the stations to the support.

15. A method of feeding yarn to a takeup machine from a creel having a plurality of supply stations each having a support for a yarn package and a pair of brake jaws between which a filament from the package passes, the method comprising the steps of:

when the takeup machine is stopped, clamping each filament between the respective jaws with a predetermined high force; and when the takeup machine is started and brought up to speed gradually and uniformly reducing the clamping force exercised by the jaws on the filament from the high force to a lower level corresponding to a desired tension in the filament, without letting the force fall below this lower level.

* * * * *